US009669404B2

(12) United States Patent
Ortiz-Hernandez et al.

(10) Patent No.: US 9,669,404 B2
(45) Date of Patent: Jun. 6, 2017

(54) ANTI-COLLAPSE FLEXIBLE FLUID CONTAINER

(71) Applicant: Bio-Rad Laboratories, Inc., Hercules, CA (US)

(72) Inventors: Luis Ortiz-Hernandez, Pinole, CA (US); Kenneth Davenport, Oakland, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 0 days.

(21) Appl. No.: 15/159,405

(22) Filed: May 19, 2016

(65) Prior Publication Data

US 2016/0256868 A1 Sep. 8, 2016

Related U.S. Application Data

(62) Division of application No. 14/297,547, filed on Jun. 5, 2014, now Pat. No. 9,371,167.

(60) Provisional application No. 61/832,476, filed on Jun. 7, 2013.

(51) Int. Cl.

| | |
|---|---|
| ***B01L 3/00*** | (2006.01) |
| ***B65D 25/38*** | (2006.01) |
| ***B65D 77/06*** | (2006.01) |

(52) U.S. Cl.

CPC ..... *B01L 3/502* (2013.01); *B01L 3/505* (2013.01); *B01L 3/508* (2013.01); *B65D 25/38* (2013.01); *B65D 77/06* (2013.01); *B01L 2200/026* (2013.01); *B01L 2300/046* (2013.01); *B01L 2300/049* (2013.01); *B01L 2300/0609* (2013.01); *B01L 2300/08* (2013.01); *B01L 2300/123* (2013.01); *B01L 2400/0481* (2013.01); *B01L 2400/06* (2013.01)

(58) Field of Classification Search

CPC ..... B01L 3/502; B01L 3/508; B01L 3/505; B01L 2300/08; B01L 2300/123; B01L 2300/0609; B01L 2400/0481; B01L 2400/06; B01L 2300/049; B01L 2300/046; B01L 2200/026; B65D 25/38; B65D 77/06

USPC ..... 222/1, 105

See application file for complete search history.

(56) References Cited

U.S. PATENT DOCUMENTS

| | | | | |
|---|---|---|---|---|
| 3,288,334 A | | 11/1966 | Corsette | |
| 3,417,901 A | * | 12/1968 | Sands | B65D 83/62 141/3 |
| 3,738,538 A | | 6/1973 | Roper et al. | |
| 3,791,557 A | | 2/1974 | Venus | |
| 3,876,115 A | | 4/1975 | Venus | |
| 3,981,415 A | | 9/1976 | Fowler et al. | |

(Continued)

*Primary Examiner* — Donnell Long

(74) *Attorney, Agent, or Firm* — Kilpatrick Townsend & Stockton LLP

(57) ABSTRACT

A valve assembly for use with a flexible container, in which the valve assembly is anchored to the flexible container. The valve assembly provides for the egress of fluid from the flexible container such that the interior surfaces flexible container do not block or otherwise prevent fluid flow or fluidic communication between the interior of the flexible container and the valve assembly. The portion of the valve assembly within the interior of the flexible container includes a support structure that prevents the walls of the flexible container from collapsing down on, and blocking either completely or in part, fluid flow through the opening of the valve inside of the flexible container.

36 Claims, 5 Drawing Sheets

(56) References Cited

U.S. PATENT DOCUMENTS

| | | | |
|---|---|---|---|
| 4,637,934 | A | 1/1987 | White et al. |
| 4,953,753 | A | 9/1990 | Gortz |
| 4,978,025 | A | 12/1990 | Fougeres et al. |
| 6,938,655 | B1 | 9/2005 | Michael et al. |
| 8,292,121 | B2 | 10/2012 | Davideit et al. |
| 2002/0033394 | A1 | 3/2002 | Towfighi et al. |
| 2003/0222100 | A1 | 12/2003 | Husband et al. |
| 2004/0094574 | A1 | 5/2004 | Sallows et al. |
| 2005/0082315 | A1 | 4/2005 | Hayakawa et al. |
| 2007/0199954 | A1 | 8/2007 | Law et al. |
| 2008/0314475 | A1 | 12/2008 | Fransen et al. |
| 2010/0276448 | A1 | 11/2010 | Moretti et al. |
| 2010/0308077 | A1 | 12/2010 | Sonntag et al. |

* cited by examiner

ANTI-COLLAPSE FLEXIBLE FLUID CONTAINER

CROSS-REFERENCES TO RELATED APPLICATIONS

The present application claims priority to U.S. patent application Ser. No. 14/297,547, filed Jun. 5, 2014, which claims the benefit of provisional patent application 61/832,476, filed on Jun. 7, 2013, which are hereby incorporated by reference. Further, U.S. provisional patent application 61/785,000 is incorporated by reference into this application.

FIELD OF THE INVENTION

The present invention generally relates to the field of storage and delivery of liquids. More specifically, many embodiments are directed to a fluid storage container, valve, and support structure that prevents the collapsing of the storage medium in a manner that blocks the flow of fluid out of the container when the storage container is connect to a wet chemistry instrument or apparatus system.

BACKGROUND OF THE INVENTION

Instruments and apparatus systems that are used for wet chemistry often require containers for the storage and delivery of liquids, such as reagents, diluents, solvents, and other fluids, to the instruments and apparatus systems. Exemplary wet chemistry instruments or apparatus systems include high pressure liquid chromatography (HPLC) instruments, ultra-high pressure liquid chromatography (UHPLC) instruments, or other such assay chemistry instrumentation. In such applications, the fluid flow from the container to the instrumentation can be affected by the shape and composition of the container.

Wet chemistry instruments, systems, and apparatus, and the related techniques, have become increasingly sophisticated and complex, allowing for the analysis of multiple samples, utilizing a variety of different solvent, buffer, diluent, and/or reagent fluid, many of which can be expensive or time-consuming to produce. Accordingly, it is important that wet chemistry instruments, systems, and apparatus efficiently distribute fluids in precise volumes for the duration of a testing technique, minimizing any loss of fluids to waste or error.

In view of the above, there remains a need to provide fluid to wet chemistry instrumentation without the disadvantages noted above and known in the field.

SUMMARY OF THE INVENTION

Many embodiments of the present disclosure are directed to a valve assembly for holding chemistry assay fluid within a flexible container. The flexible container may have an opening. A valve may be anchored in the opening. A support structure may extend from the valve within the interior of the flexible container. The support structure may be adapted to prevent an interior surface of the flexible container from blocking fluidic communication between the interior of the flexible container and the valve. Further embodiments include a valve assembly for holding chemistry assay fluid within a flexible container, the valve assembly having a rigid container having a first opening, a flexible container having a second opening, the flexible container being mounted within the rigid container such that first opening and second opening are in alignment, a valve anchored in the second opening, a support structure extending from the valve within the interior of the flexible container, the support structure being adapted to prevent an interior surface of the flexible container from blocking fluidic communication between the interior of the flexible container and the valve. Such embodiments may further include a support structure in the form of a cage, a corkscrew-shaped cage, a multi-arm cage, and/or an extended beam. When the support structure is an extended beam, embodiments can also have a base molded, bonded, or otherwise affixed to the extended beam, a cross-shaped structure for the extended beam, and/or at least one crosspiece positioned along the length of the extended beam. In many embodiments, the flexible container can be made of an elastic, an inelastic, or a semi-elastic material. In many embodiments, the flexible container can be constructed of at least a first sheet and a second sheet of elastic, inelastic, or semi-elastic material, the first sheet and second sheet being sealed along their edges. In further embodiments, the flexible container is shaped such that, as assay fluid egresses the flexible container, the interior surface of the flexible container does not block the flow of assay fluid through the support structure or valve. In many embodiments, the flexible container is subjected to a pressurized environment such that an assay fluid held within the flexible container egresses through the valve at a positive pressure.

Many embodiments of the present disclosure are directed to a method of delivering chemistry assay fluid from a flexible container. A flexible container may be mounted within a rigid container, holding a chemistry assay fluid may be held within the flexible container. The chemistry assay fluid may be egressed the flexible container through a valve anchored in the flexible container. A support structure may prevent any surface of the flexible container from blocking fluidic communication between the interior of the flexible container and the valve. Many embodiments include preventing the walls of the flexible container from collapsing onto the port of the valve by use of a support structure where the structure is a cage, a corkscrew-shaped cage, a multi-arm cage, and/or an extended beam. In many embodiments, the extended beam may have a base structure distal from the valve. Many embodiments cause the chemistry assay fluid to egress the flexible container through a valve anchored in the flexible container by pressurizing a volume of space between the exterior of the flexible container and the interior of the rigid container.

DETAILED DESCRIPTION OF THE INVENTION

Figure 1C:
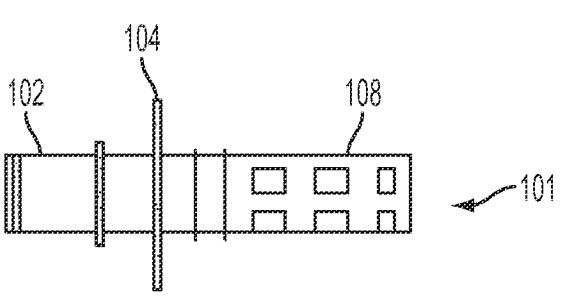
FIGS. 1A, 1B, and 1C depict schematic representations of configurations for a valve for use with a fluid-filled flexible container according to many embodiments.

Throughout this description for the purposes of explanation, numerous specific details are set forth in order to provide a thorough understanding of the many embodiments disclosed herein. It will be apparent, however, to one skilled in the art that the many embodiments may be practiced without some of these specific details. In other instances, well-known structures and devices are shown in diagram or schematic form to avoid obscuring the underlying principles of the described embodiments.

Many embodiments are directed to a valve and an anti-collapse support structure incorporated with a flexible fluid container, where the anti-collapse support structure operates to prevent the flexible container from folding, bunching, or collapsing in on the valve. Such containers can be bags, pouches, sacks, and the like, which may have a semi-rigid or flexible structure for holding fluids; these containers can generally be referred to as flexible containers. A container that delivers fluids to instrument and apparatus systems may also be a combination of two or more containers, such as a flexible container mounted or supported within a rigid container, such as a bottle. Delivery of a liquid to a wet chemistry instrument often relies on the use of pumps or gravity to draw and/or drain a fluid from a flexible container into the instrument. The fluid drawn and/or drained from a flexible container may also be pressurized, depending on the instrument and delivery system. Generally, the flexible fluid containers can be constructed by sealing together two sheets of material along their edges. In other embodiments, the flexible container can be constructed from a single piece of an appropriate material, or alternatively assembled from more than two pieces of material. The material can be an elastic, inelastic, or semi-elastic material, which is generally not permeable to fluids or gases. The material, when formed into a container, is flexible and malleable enough to change its shape as a fluid enters or exits the container. In one of the pieces of material, there is an opening or hole through a rigid port can pass through, which will allow fluidic communication into and out of the flexible container. The port is sealed to the bottle and provides an anchor point. Once the flexible container is assembled, fluid can be filled into the flexible container and subsequently, a rigid valve is fitted and anchored into the port. The anti-collapse support structures, which are mechanically connected or coupled to and modify, the valve structures, are able to fit through the port, which minimizes the impact to the flexible container manufacturing process. Both the port and the valve can be made of a plastic or other material, which retains the desired structural properties and is made of a biologically and chemically inert material capable of withstanding the range of solvents, acids, bases, and other liquids that can have corrosive characteristics.

It has been found that when a fluid-filled flexible container is more than fifty percent (50%) empty, the flexible container can fold, bunch up, or pinch up in random ways to hinder, irregularly interrupt, or stop the flow of fluid to the instrument to which the flexible container is connected. Such folding, bunching, or pinching can be caused by the operator when handling, carrying, or inserting a bottle onto the instrument. Similarly, partial or complete blockage of fluid flow can occur if the fluid-holding flexible container folds over onto the structure of the port and/or portion of the valve located within the interior of the flexible container. Alternately, a fluid-holding flexible container can collapse at a location toward the middle of the flexible container, isolating some volume of fluid at the rear of the flexible container, causing behavior similar to when a container is empty, and essentially blocking fluid flow. The collapsing of a flexible fluid container may trigger an instrument to erroneously detect or sense that the fluid-holding container is empty or that there is a blockage in flow, the instrument may incorrectly indicate that there is an error or problem related to the amount of fluid available. The instrument may prompt a user to change the fluid container before all of the fluid in the container has been drawn from and used by the instrument, possibly reducing the number of diagnostic tests that can be run based on the volume of fluid in the container. Alternatively, if the bottles stop delivering fluid, the instrument may fault and stop, interrupting workflow and forcing a re-test of one or more samples, costing the instrument operator and the operating laboratory valuable time.

Many embodiments address a problem where, as a chemistry assay fluid stored within a flexible container egresses through a port and/or valve, the flexible container collapses, folds, bends, crimps, or otherwise randomly deforms in a manner that blocks the flow of chemistry assay fluid through the valve and/or port. The blockage of the port and/or valve can lead to an intermittent fluid flow from the flexible container to the instrument or apparatus to which the flexible container is connected. The deformation of the flexible container can be more pronounced when the fluid-filled flexible container has less than fifty percent (50%) of the original volume of chemistry assay fluid remaining within the container. The deformation of the flexible container can also be more pronounced when the flexible container is subjected to a pressurized environment that is intended to provide the chemistry assay fluid at a positive pressure to the connected instrument or apparatus. Although the deformation of the flexible container cannot be prevented, since the egress of chemistry assay fluid from the interior of the container will naturally lead a reduction of the volume of the container, the manner of collapse of the flexible container can be controlled. Controlling the manner of the flexible container collapse provides for a more consistent and controlled flow of chemistry assay fluid out of the flexible container, and thus an improved performance for any instrument or apparatus to which the flexible container is delivering chemistry assay fluid.

In many embodiments, a valve is located and anchored to a port in the flexible container, and provides an interface for fluidic communication between the interior and exterior of the flexible container. As used herein, the term "valve head" refers to the portion of a valve that is the outer portion of the valve, and is in communication with the environment external to the flexible container. The term "valve tail" refers to the portion of a valve that is the inner portion of the valve, and is in communication with the interior volume of the flexible container. The term "valve seal wall" refers to the portion of a valve that anchors the over valve to the flexible container in which the valve is located. A "valve core" as disclosed herein may connect with a valve head and valve tail, and may be located in communication with the environment external to the flexible container, in communication with the interior volume of the flexible container, or in communication with both. Further, as used herein, a "fluid" may refer to a chemistry assay fluid, though many embodiments do not necessarily require use of a chemistry assay fluid as the fluid within a flexible container.

In many embodiments, the flexible container can be mounted and secured within a rigid container (e.g. a bottle), alternatively referred to as an outer shell, such that the opening of the flexible container in which a valve is located and anchored is in alignment with an opening in the rigid container. The valve accordingly allows for fluidic communication between the interior of the flexible container and the exterior of the rigid container.

In many embodiments, the valve is set to an open configuration when the valve and the container in which the valve is located are coupled and/or secured to a connection on an instrument or apparatus. When coupled or connected with an instrument or apparatus, the valve in an open configuration allows for fluidic communication between the interior of the flexible container and the receiving structure of the instrument or apparatus to which the valve is connected. Conversely, the valve is set to a closed configuration when the valve and the container in which the valve is located are not connected or coupled to any other instrument or apparatus. In many embodiments, the valve may be a switch valve, a ball valve, a one-way valve, or the like.

It is to be noted that while the many embodiments disclosed herein are generally directed to wet chemistry instrumentation and apparatus, the valve assembly and flexible container system for the delivery of fluid can be used for any appropriately designed instrument that requires the storage and delivery of reagents, buffers, diluents, solvents, or other fluids.

Further, the present invention allows for a flexible container mounted in various orientations (e.g. vertically, horizontally, in cantilever, above an instrument, below an instrument, etc.) where in each orientation, the anti-collapse structure operates to prevent the flexible container from blocking the valve and/or port through which the fluid egresses.

Figure 1B:
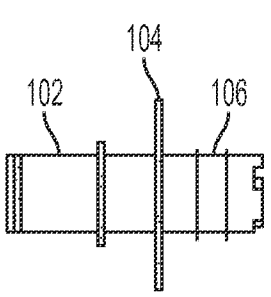
Figure 1A:
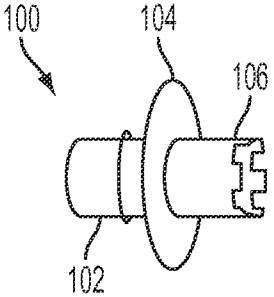

FIGS. 1A, 1B, and 1C depict schematic representations of valves 100/101 for use with a flexible container. The valves 100/101 each have a valve head 102, a valve seal wall 104, and a valve tail 106/108. Valve 100 is presented with two side-profile schematic representations from two perspectives as FIGS. 1A and 1B. Valve 101 is presented with one side-profile schematic representation as FIG. 1C. The valve head 102 and valve tail 106/108 each have an internal space that together align to form a hollow passageway through which materials and fluids can flow, and are distinguished by the fact that in application the valve head 102 resides external to the container in which the valve 100/101 is located and the valve tail 106/108 resides in the interior of the container. The valve seal wall 104 is formed around the exterior surface of the valve 100 and generally demarcates the intersection of the valve head 102 and the valve tail 106/108. The valve seal wall 104 provides structure by which the valve 100 is anchored to the container in which the valve is located. With regard to the valve 100, the valve tail 106 extends from the valve seal wall 104 a distance, where the end of the valve tail 106 is open to the interior of the flexible container and may have a comb-like, parapet, or saw-tooth structure along its circumference as illustrated in FIGS. 1A and 1B. The structure at the end of the tail valve 106 may alternatively be smooth, blunted, or uninterrupted along its circumference. In any embodiment, the structure at the end of the tail valve 106 should be configured to allow for efficient fluid flow into and through the valve 100. With regard to the valve 101, the valve tail 108 extends from the valve seal wall 104 a distance (which can be relatively greater than the distance valve tail 106 extends in valve 100) and has a mesh-like cage structure with openings or slots along the surface of the valve tail 108 to allow for fluid flow. The end of the valve tail 108 is open to the interior of the flexible container and may have a smooth, blunt, or uninterrupted structure along its circumference as illustrated in FIG. 1C. The structure at the end or edge of the tail valve 108 may alternatively have a comb-like, parapet, or saw-tooth structure along its circumference. In many embodiments, the structure at the end of the tail valve 108 is configured to allow for efficient fluid flow into and through the valve 101.

Figure 2A:
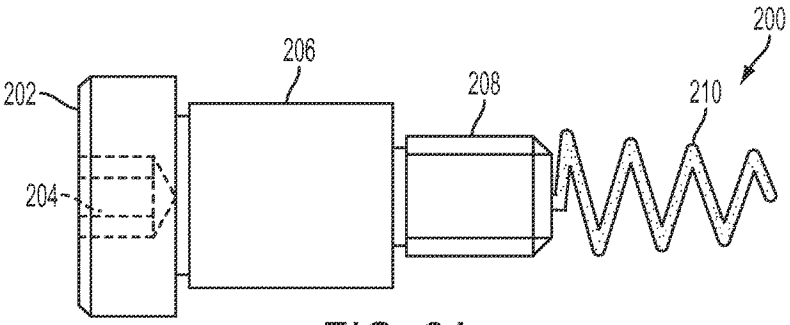
FIGS. 2A, 2B, and 2C depict three schematic representations of the valve with an anti-collapse support structure according to many embodiments.
Figure 2B:
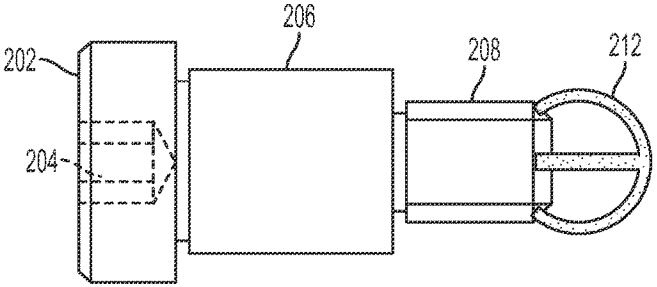
Figure 2C:
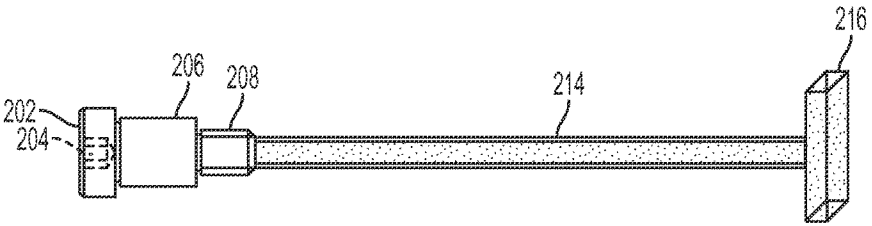

FIGS. 2A, 2B, and 2C depict three side profile schematic representations of the valve with anti-collapse support structure 200 according to three embodiments of the invention. Each of the valves in FIGS. 2A, 2B, and 2C has a valve head 202, an exterior valve interface 204, a valve core 206, and a valve tail 208. The valve tail 208 and valve core 206 each have an internal space that align to form and define a hollow passageway and port, which connects to the exterior valve interface 204 residing in the valve head 202, through which materials and fluids can flow. In each of the representative embodiments illustrated, an anti-collapse support structure is mechanically connected to the valve tail 208 and, when mounted in a flexible container, extends past the end of the valve tail further into the interior of the flexible container. In many embodiments, the valve head 202 can have a width (i.e. the length of the element transverse to the direction of the hollow passageway) greater than the valve core 206, both of which can have a width greater than the valve tail 208. In other embodiments, the valve head 202, valve core 206, and valve tail 208 can have widths appropriate for coupling with any given flexible container or any given instrument or apparatus. Each embodiment of the anti-collapse support structure prevents the walls of the flexible container from collapsing onto the port of the valve. In many embodiments, the valve and anti-collapse support structure 200 may be constructed from polymer materials. In further embodiments the valve and anti-collapse support structure 200 may be at least partially coated, bonded, and/or incorporated with a supplementary material, which can provide structural reinforcement and/or a barrier to chemical interactions with fluids that come into contact with the valve and anti-collapse support structure 200. In some embodiments, a valve and anti-collapse support structure may be fabricated from a glass-reinforced polypropylene material (glass fiber chemically coupled to polypropylene).

In many embodiments, such as the valve of FIG. 2A, the anti-collapse support structure is a corkscrew-shaped anti-collapse support structure 210. The corkscrew-shaped anti-collapse support structure 210 (alternatively referred to as a "cage") can be flared to have a diameter larger than the port opening at the end of the valve tail 208, while still being of a sufficient size to be threaded through, or screwed into, the flexible container through the opening for the valve port. The corkscrew-shaped anti-collapse cage 210 provides a structure that prevents the walls of the flexible container from collapsing onto the port of the valve 201, and subsequently blocking, covering, or otherwise impeding egress of fluid through the valve and port. The corkscrew-shaped anti-collapse cage 210 can have a terminus in line with the longitudinal axis of the valve 201, which mitigates against the end of the corkscrew-shaped anti-collapse cage 210 inadvertently puncturing the flexible container material.

In many embodiments, such as the valve of FIG. 2B, the anti-collapse support structure is a multi-arm cage anti-collapse support structure 212. The multi-arm cage anti-collapse support structure 212 can be of a sufficient size to fit into the flexible container through the opening for the valve port. In many embodiments, the multi-arm cage 212 can be constructed from either an assembly of individual arm pieces or as a single-piece structure. The single-piece structure or individual arms which form the multi-arm cage anti-collapse support structure 212 can have a spring tension, such that the single-piece structure or individual arms can deformed to be narrower than the diameter of the valve port opening in the flexible container, and then revert to its zero-tension structure, once located in the interior of the flexible container. In many embodiments, there can be at least one individual arm where both ends of the individual arm mechanically connects to the valve tail 208. Where there is more than one individual arm forming the multi-arm cage anti-collapse support structure 212, the apex of each individual arm can meet and intersect at a point equidistant from the opening to the port located on the valve tail 208. The multi-arm cage anti-collapse support structure 212 provides a structure that prevents the walls of the flexible container from collapsing onto the port of the valve 203, and subsequently blocking, covering, or otherwise impeding egress of fluid through the valve and port. The multi-arm cage anti-collapse support structure 212 can have a terminus in line with the longitudinal axis of the valve 203, which mitigates against the end of the multi-arm cage anti-collapse support structure 212 inadvertently puncturing the flexible container material. In many embodiments, the single-piece structure or individual arms can be shaped to provide for particular multi-arm cage 212 structures. For example, as illustrated in FIG. 2B, the multi-arm cage anti-collapse support structure 212 has curved arms forming the overall multi-arm cage. In other embodiments the arms of the multi-arm cage anti-collapse support structure 212 can have, and can combine to form, a pseudo-square, hexagonal, octagonal, or other such structure.

In many embodiments, such as the valve of FIG. 2C, the anti-collapse support structure is an extended beam anti-collapse support structure 214 with an extended beam base 216. The extended beam anti-collapse support structure 214 can extend from the end of the valve tail 208 along the length of the flexible container, where the length of the extended beam anti-collapse support structure 214 can be less than a majority of the flexible container length, about a majority of the flexible container length, greater than a majority of the flexible container length, or almost the entirety of the flexible container length. The end of the extended beam anti-collapse support structure 214 distal from the valve tail can also have an extended beam base 216, flaring from or widening the end of the extended beam anti-collapse support structure 214 proximate to the portion of the flexible container that may shift toward the valve and port, or collapse in another direction, as fluid egresses the flexible container. The extended beam base 216 can have a shape that is designed to efficiently prevent the flexible container from collapsing in on the valve 205, where the shape of the extended beam base 216 can be rectangular, circular, spherical, pronged, or of any other appropriate geometric shape. The shape of the extended beam base 216 may mitigate against the end of the extended beam base 216 from inadvertently puncturing the flexible container material. The extended beam base 216 also fits through the opening and port in the flexible container when a valve is inserted and anchored in the flexible container. The extended beam base 216 may be made of a spring material, which can be deformed to fit through the opening and port, but when restored to its zero-tension state, have a width dimension that is greater than the size of the opening and port.

In many embodiments, the extended beam anti-collapse support structure 214 fits within and extends outward from the opening of the valve tail 208. A guide ring or guide arms (not shown) may be provided to align and secure the extended beam anti-collapse support structure 214 within the opening of the valve tail 208 while preventing the extended beam anti-collapse support structure 214 from blocking the path of fluid flow and fluidic communication from the interior of the flexible container through the valve. The extended beam anti-collapse support structure 214 and extended beam base 216 are constructed to avoid inadvertently puncturing the flexible container material.

A more direct variation for modifying the valve tail of a port is to simply extend the length of the valve to have a greater length such that the valve tail extends further into the interior of the flexible container. The extended valve tail may keep the flexible container from collapsing or folding over the valve tail port opening and thus allow fluid to flow through. For example, in reference to the valve 100, the valve tail 108 may be extended to about twice its length relative to the valve seal wall 104.

Figure 3:
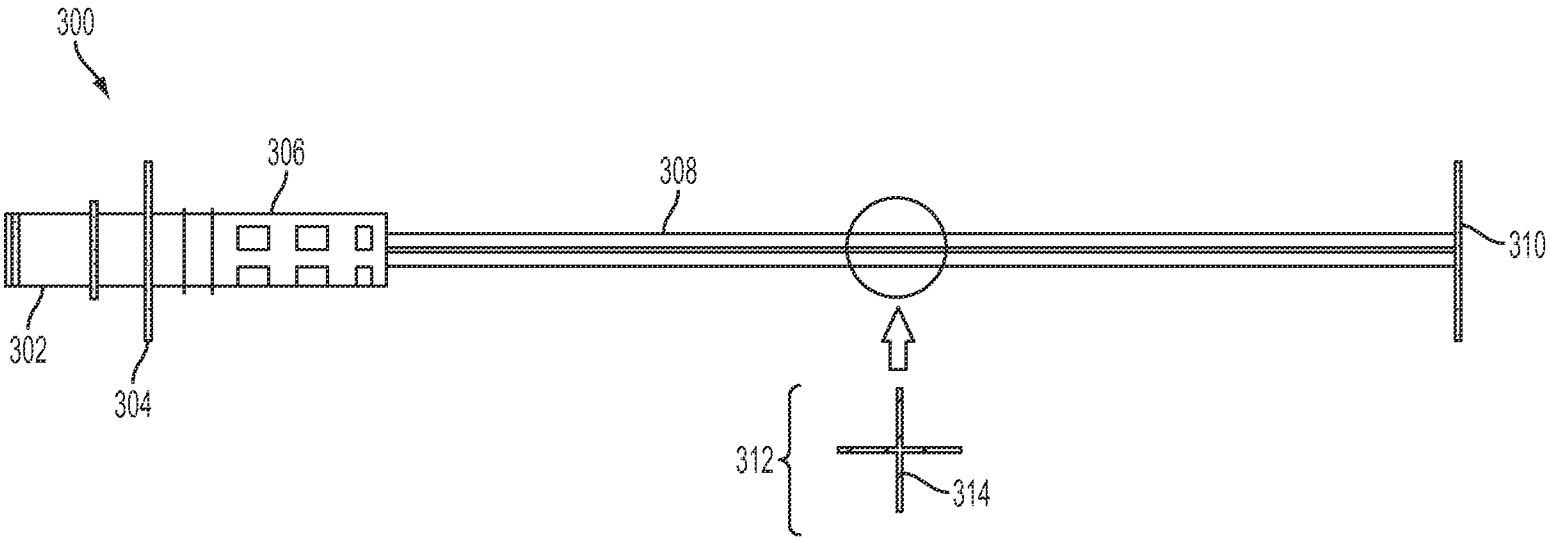
FIG. 3 depicts a schematic representation of the valve with an anti-collapse support structure and cross-sectional view of the support structure according to many embodiments.

FIG. 3 depicts a schematic representation of the valve with an extended beam anti-collapse support structure 300 and a cross-sectional view of the support structure according to an embodiment of the invention. The valve head 302, valve seal wall 304, and valve tail 306 each have an internal space that align and to form a hollow passageway, constituting a valve and port that can be anchored into a port of a flexible container. The extended beam anti-collapse support structure 308 that extends from the valve tail 306 can be bonded, molded, or otherwise affixed to the valve tail 306 or formed of the same material as the valve tail 306. The extended beam anti-collapse support structure 308 can further have an extended beam base 310 that flares from or widens the end of the extended beam anti-collapse support structure 308 proximate to the portion of the flexible container that may shift toward the valve and port, or collapse in another direction, as fluid egresses the flexible container. In many embodiments, the extended beam base 310 can have a rectangular structure as illustrated in FIG. 3. In other embodiments, the extended beam base 310 can have a spherical structure, an oblong structure, an irregular structure, or a structure that is based upon and extends the width, length, or thickness of the extended beam 308 at the end of the extended beam 308 distal from the valve tail 306.

In many embodiments, the extended beam anti-collapse support structure 308 can be shaped as a cross, shown in FIG. 3 in cross-section as element 312. In such embodiments where the extended beam 308 is shaped as a cross, the spaces between each flange of the cross shape can define fluidic channels 314 that aid the flow of fluid from the interior of the flexible container towards the opening at the valve tail 306. Alternative embodiments of the extended beam 308 may be shaped to have fluidic channels 314 in the form of grooves along the extended beam 308 or with other structures based upon the shape of the extended beam 308. In many embodiments, the extended beam anti-collapse support structure 308 can be a rod with a circular or other geometric shape, or a central rod with two or more flanges or spokes extending from the central rod. The extended beam anti-collapse support structure 308 has sufficient structural strength to withstand pressure applied to the exterior of the flexible container without experiencing mechanical failure such as shearing or collapsing.

Figure 4A:
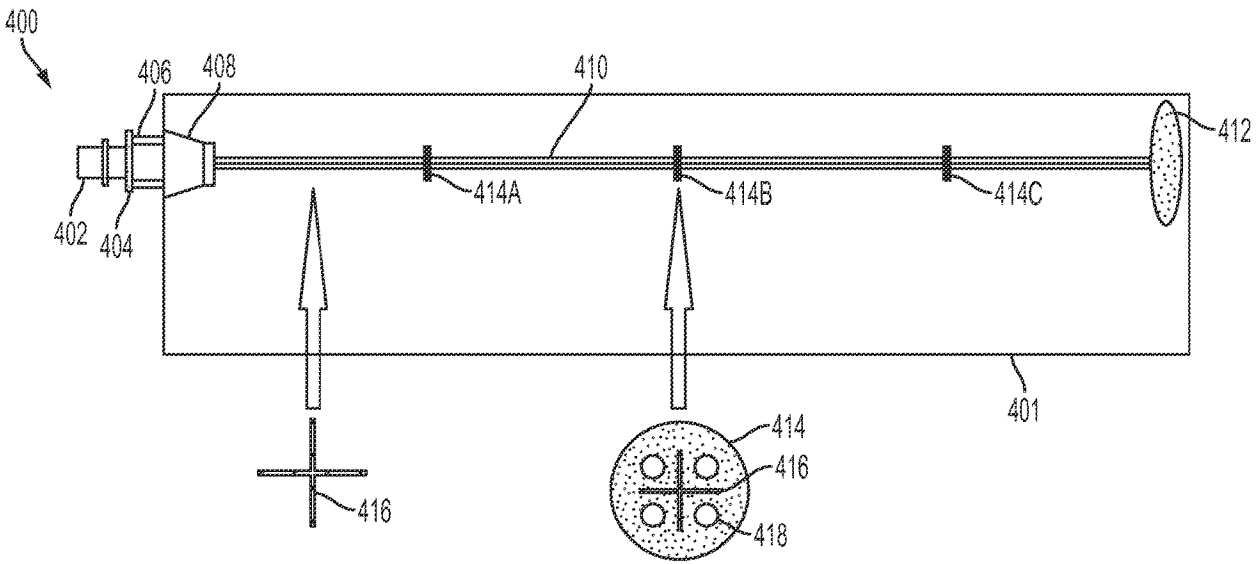
FIG. 4A depicts a schematic representation of the valve with an anti-collapse support structure and cross-sectional views of the support structure according to many embodiments.

FIG. 4A depicts a schematic representation of the valve with an extended beam anti-collapse support structure and cross-sectional views of the support structure according to many embodiments. The valve has valve head 402, a valve wall 404, a valve core 406, and a valve tail 408. The valve head 402, valve core 406, and valve tail 408 each have an internal space that align and form a hollow passageway through which materials and fluids can flow. The valve wall 404 is formed around the exterior surface of the valve 400 and generally demarcates the intersection of the valve head 402 and the valve core 406. The valve 400, being anchored to the flexible container 401, can have the valve tail 408 reside within the interior volume of the flexible container 401. An anti-collapse support beam 410 is mechanically connected to the valve tail 408 and can extend from the end of the valve tail 408 through the length of the flexible container 401. A support beam base 412 is mechanically connected to the end of the anti-collapse support beam 410 distal from the valve tail 408 and flares from or widens the end of the anti-collapse support beam 410 proximate to the portion of the flexible container that may shift toward the valve and port, or collapse in another direction, as fluid egresses the flexible container. The anti-collapse support beam 410 can be shaped as a cross, shown in FIG. 4 in cross-section as element 416. In alternative embodiments of the invention, the anti-collapse support beam 410 can be a rod with a circular or other geometric shape, or a central rod with two or more flanges or spokes extending from the central rod. The anti-collapse support beam 410 can further have one or more support beam crosspieces 414 along the length of the anti-collapse support beam 410. The support beam crosspieces 414 can provide structural support to the anti-collapse support beam 410, preventing the beam itself from collapsing when the flexible container 401 contracts as fluid egresses through the valve. The support beam crosspieces 414 surround a portion of the anti-collapse support beam 410, and can be formed as part of the beam 410 when the beam is fabricated, or added on later and affixed to the beam 410. Further, the support beam crosspieces 414 may have flow openings 418 to allow for fluid flow past and through the support beam crosspieces 414 that minimizes any turbulence that may be generated from the presence of the support beam crosspieces 414. The support beam crosspieces 414 may be distributed at regular intervals along the anti-collapse support beam 410, for example as elements 414A, 414B, 414C in FIG. 4A. In other embodiments of the invention, the support beam crosspieces 414 may be distributed at different points along the anti-collapse support beam 410, with the positions chosen based on the on the desired structural support or effect on fluid flow within the flexible container 401.

Figure 4B:
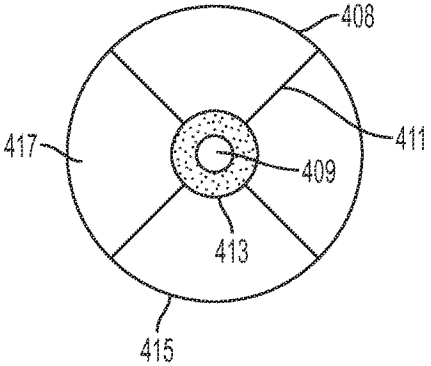
FIG. 4B depicts an overhead view of schematic representation a valve section according to many embodiments.
Figure 4C:
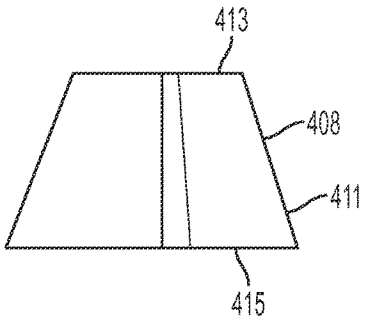
FIG. 4C depicts a side-profile view of schematic representation a valve section according to many embodiments.
Figure 5:
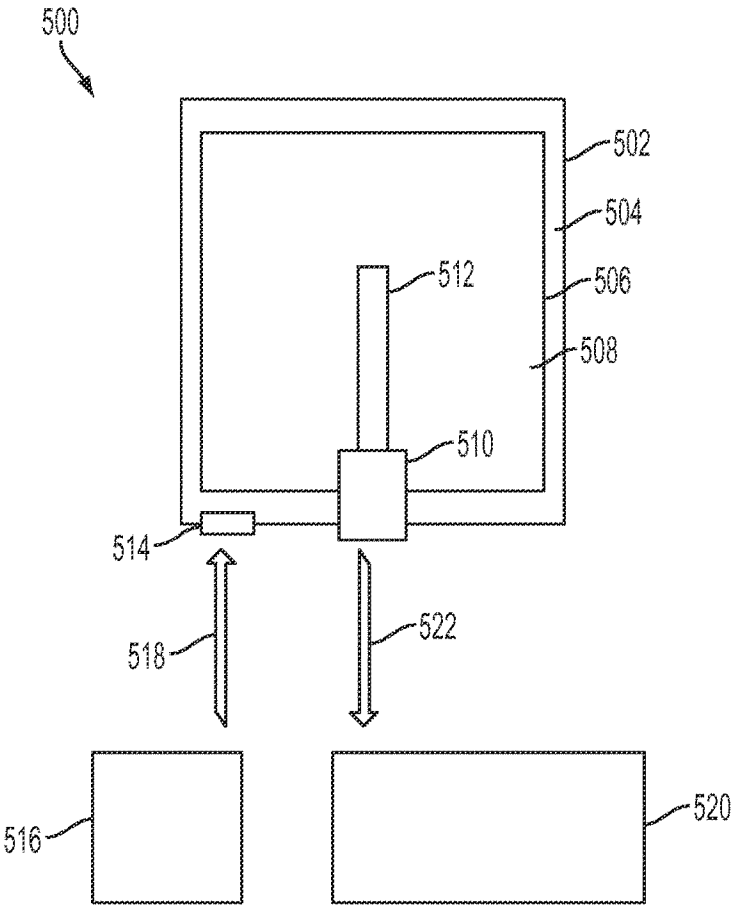
FIG. 5 is a system diagram of the interaction between valve with an anti-collapse support, flexible container, and rigid container with chemistry instrumentation and apparatus.

FIG. 4B depicts an overhead view of schematic representation a valve tail 408 according to an embodiment. Similarly, FIG. 4C depicts a side-profile view of schematic representation a valve tail 408 according to an embodiment of the invention. The valve tail 408 in the illustrated embodiment is constructed from a first ring 413 and a second ring 415 that are connected by support dowels 411 and can be concentric in orientation. The first ring 413 is generally smaller than the second ring 415, where the first ring is connected to an anti-collapse support structure (such as the anti-collapse support beam 410 as depicted in FIG. 4A) and the second ring is the portion of the valve tail 408 connected to the valve core 406. In many embodiments, the valve tail 408 may by itself function as an anti-collapse support structure. The first ring 413 defines a first opening 409 that is narrower in diameter than a second opening 417 defined by the second ring 415. Both the first opening 409 and second opening 417 provide for a flow path for fluidic communication from the interior of a flexible container into and through the valve. The support dowels 411 maintain a distance between the first ring 413 and second ring 415 and a semi-pyramidal structure. In other embodiments, there can be any number of support dowels 411, so long as a flow path for fluidic communication from the interior of a flexible container into and through the valve remains. In other embodiments, the first ring 413 and second ring 415 may be non-circular shapes, so long as a first opening 409 and second opening 417 are defined and provide for a flow path for fluidic communication from the interior of a flexible container into and through the valve FIG. 5 is a schematic illustration of a system 500 of the valve assembly 510 and anti-collapse support structure 512 anchored within a flexible container 506, which is in turn mounted within a rigid container 502. As described herein, the rigid container 502 and the flexible container 506 are evaluated as rigid or flexible relative to each other. In FIG. 5 the rigid container 502 surrounds and defines a volume 504 that contains at least a flexible container 506 that can hold an assay fluid within its interior volume 508. In many embodiments, a pressurized gas 518 (e.g. air) is pumped from a pressurization system 516, which is a part of or coupled to the chemistry instrumentation or apparatus, and enters the volume 504 through a gas interface port 514 in the rigid container 502. In many embodiments, gas interface port 514 may be separate from or coupled with the portion of the valve assembly 510, which is located in the opening of the rigid container 502. In either case, the rigid container is otherwise sealed to prevent the exchange of gas between the volume 504 and the external environment. As pressurized gas fills the volume 504, the pressure on the exterior surface of the flexible container 506 increases, reducing the volume of the interior volume 508 of the flexible container 506. The rigid container 502 is able to withstand the force exerted by the pressurized gas, retaining its form and seal, within desired tolerances. As the volume of the flexible container 506 decreases, any assay fluid in the interior volume 508 of the flexible container 506 accordingly exits the flexible container 506 if possible, and is ideally pushed out through the valve assembly 510 at a positive pressure. The fluid stream 522 egresses to the fluidic testing system 520 of the related chemistry instrumentation or apparatus. The valve assembly 510 may also include a shut-off valve, such that when the valve assembly 510 is not coupled to an appropriate receiving connector for a chemistry instrumentation or apparatus, assay fluid inside the flexible container 506 is prevented from egressing out of the flexible container 506. If assay fluid from the flexible container 506 exits into the volume 504, the shut-off valve can also operate to prevent leakage of the solvent out of the rigid container 502.

The valve assembly system 500 includes an anti-collapse support structure 512, located within the flexible container 506, which is bonded, molded, or otherwise affixed to the portion of the valve within the interior volume 508 of the flexible container 506. The anti-collapse support structure 512 extends from the valve 510 within the interior volume 508 of the flexible container 506. Accordingly, if the flexible container 506 collapses, bends, contorts, or otherwise reduces its interior volume 508, anti-collapse support structure 512 functions to prevent the internal surfaces of the flexible container 506 from blocking fluidic communication from the interior volume 508 through the valve assembly 510. As noted in many embodiments above, the anti-collapse support structure 512 can be a cage structure, a beam structure, and variations thereof.

In many embodiments, the flexible container may be shaped such that as fluid egresses the flexible container, and as the flexible container accordingly collapses, the flexible container tends to contort in a manner that matches or accommodates the structure of an anti-collapse support structure residing in the interior of the flexible container, or in a manner that avoids collapsing in on a valve port. In other words, the flexible container can be shaped such that the interior surfaces of the flexible container do not block (either entirely or in art) the flow of fluid through the anti-collapse support structure or valve as the flexible container is drained of fluid. Similarly, the flexible container may be tapered or otherwise shaped to mitigate against fluids becoming trapped in pockets of volume separated from the valve port as the flexible container reduces in volume.

The above description is illustrative and is not restrictive, and as it will become apparent to those skilled in the art upon review of the disclosure, that the present invention may be embodied in other specific forms without departing from the essential characteristics thereof. For example, any of the aspects described above may be combined into one or several different configurations, each having a subset of aspects. Further, throughout the foregoing description, for the purposes of explanation, numerous specific details were set forth in order to provide a thorough understanding of the invention. It will be apparent, however, to persons skilled in the art that these embodiments may be practiced without some of these specific details. These other embodiments are intended to be included within the spirit and scope of the present invention. Accordingly, the scope of the invention should, therefore, be determined not with reference to the above description, but instead should be determined with reference to the following and pending claims along with their full scope of legal equivalents.

What is claimed is:

1. A valve assembly for holding chemistry assay fluid within a flexible container, the valve assembly comprising:
- a rigid container having a first opening;
- a flexible container having a second opening, the flexible container being mounted within the rigid container such that first opening and second opening are in alignment;
- a valve anchored in the second opening;
- a corkscrew-shaped cage support structure, extending from the valve within the interior of the flexible container, the support structure adapted to prevent an interior surface of the flexible container from blocking fluidic communication between the interior of the flexible container and the valve.

2. A valve assembly according to claim 1, wherein the support structure comprises a multi-arm cage.

3. A valve assembly according to claim 2, wherein the multi arm-cage comprises one or more curved arms.

4. A valve assembly according to claim 1, wherein the support structure further comprises a beam extending from the cage support structure.

5. A valve assembly according to claim 4, wherein the extended beam comprises a cross-shaped structure.

6. A valve assembly according to claim 4, wherein the support structure further comprises an extended beam base mechanically coupled to a distal end of the extended beam.

7. A valve assembly according to claim 4, wherein the support structure further comprises at least one crosspiece positioned along the length of the extended beam.

8. A valve assembly according to claim 1, wherein the flexible container is comprised of an elastic, an inelastic, or a semi-elastic material.

9. A valve assembly according to claim 8, wherein the flexible container is comprised of at least a first sheet and a second sheet of elastic, inelastic, or semi-elastic material, the first sheet and second sheet being sealed along their edges.

10. A valve assembly according to claim 1, wherein the flexible container is shaped such that, as assay fluid egresses the flexible container, the interior surface of the flexible container does not block the flow of assay fluid through the support structure or valve.

11. A valve assembly according to claim 1, wherein the flexible container is adapted to be subjected to a pressurized environment such that an assay fluid held within the flexible container egresses through the valve at a positive pressure.

12. A valve assembly according to claim 11, wherein a space between the exterior of the flexible container and the interior of the rigid container is adapted to be pressurized.

13. A method of delivering chemistry assay fluid from a flexible container, the comprising:
- mounting a flexible container within a rigid container;
- holding a chemistry assay fluid within the flexible container;
- causing the chemistry assay fluid to egress the flexible container through a valve anchored in the flexible container; and
- preventing with a corkscrew-shaped cage support structure any surface of the flexible container from blocking fluidic communication between the interior of the flexible container and the valve, wherein the corkscrew-shaped cage support structure prevents the walls of the flexible container from collapsing onto the port of the valve.

14. A method of delivering chemistry assay fluid according to claim 13, wherein the support structure is a multi-arm cage that prevents the walls of the flexible container from collapsing onto the port of the valve.

15. A method of delivering chemistry assay fluid according to claim 13, wherein the multi-arm cage comprises one or more curved arms.

16. A method of delivering chemistry assay fluid according to claim 13, wherein the support structure further comprises a support beam extending from the cage support structure.

17. A method of delivering chemistry assay fluid according to claim 16, wherein the support beam further comprises a base structure distal from the valve.

18. A method of delivering chemistry assay fluid according to claim 13, further comprising causing the chemistry assay fluid to egress the flexible container through a valve anchored in the flexible container by pressurizing a volume of space between the exterior of the flexible container and the interior of the rigid container.

19. A valve assembly for holding chemistry assay fluid within a flexible container, the valve assembly comprising:
- a rigid container having a first opening;
- a flexible container having a second opening, the flexible container being mounted within the rigid container such that first opening and second opening are in alignment;
- a valve anchored in the second opening;
- a cage support structure and a beam extending from the cage support structure, extending from the valve within the interior of the flexible container, the support structure and beam adapted to prevent an interior surface of the flexible container from blocking fluidic communication between the interior of the flexible container and the valve.

20. A valve assembly according to claim 19, wherein the support structure comprises a corkscrew-shaped cage.

21. A valve assembly according to claim 19, wherein the support structure comprises a multi-arm cage.

22. A valve assembly according to claim 21, wherein the multi arm-cage comprises one or more curved arms.

23. A valve assembly according to claim 19, wherein the support structure further comprises an extended beam base mechanically coupled to a distal end of the extended beam.

24. A valve assembly according to claim 19, wherein the support structure further comprises at least one crosspiece positioned along the length of the extended beam.

25. A valve assembly according to claim 19, wherein the flexible container is comprised of an elastic, an inelastic, or a semi-elastic material.

26. A valve assembly according to claim 25, wherein the flexible container is comprised of at least a first sheet and a second sheet of elastic, inelastic, or semi-elastic material, the first sheet and second sheet being sealed along their edges.

27. A valve assembly according to claim 19, wherein the flexible container is shaped such that, as assay fluid egresses the flexible container, the interior surface of the flexible container does not block the flow of assay fluid through the support structure or valve.

28. A valve assembly according to claim 19, wherein the extended beam comprises a cross-shaped structure.

29. A valve assembly according to claim 19, wherein the flexible container is adapted to be subjected to a pressurized environment such that an assay fluid held within the flexible container egresses through the valve at a positive pressure.

30. A valve assembly according to claim 29, wherein a space between the exterior of the flexible container and the interior of the rigid container is adapted to be pressurized.

31. A method of delivering chemistry assay fluid from a flexible container, the comprising:

mounting a flexible container within a rigid container;

holding a chemistry assay fluid within the flexible container;

causing the chemistry assay fluid to egress the flexible container through a valve anchored in the flexible container; and preventing with a cage support structure and a beam extending from the cage support structure any surface of the flexible container from blocking fluidic communication between the interior of the flexible container and the valve, wherein the cage support structure and the beam prevent the walls of the flexible container from collapsing onto the port of the valve.

32. A method of delivering chemistry assay fluid according to claim 31, wherein the support structure is a corkscrew-shaped cage that prevents the walls of the flexible container from collapsing onto the port of the valve.

33. A method of delivering chemistry assay fluid according to claim 31, wherein the support structure is a multi-arm cage that prevents the walls of the flexible container from collapsing onto the port of the valve.

34. A method of delivering chemistry assay fluid according to claim 31, wherein the multi-arm cage comprises one or more curved arms.

35. A method of delivering chemistry assay fluid according to claim 31, wherein the support beam further comprises a base structure distal from the valve.

36. A method of delivering chemistry assay fluid according to claim 31, further comprising causing the chemistry assay fluid to egress the flexible container through a valve anchored in the flexible container by pressurizing a volume of space between the exterior of the flexible container and the interior of the rigid container.

* * * * *